US006487427B1

(12) United States Patent
Tatekawa et al.

(10) Patent No.: US 6,487,427 B1
(45) Date of Patent: Nov. 26, 2002

(54) DIELECTRIC RESONATOR, DIELECTRIC FILTER, DIELECTRIC DUPLEXER, AND COMMUNICATIONS DEVICE HAVING SPECIFIC DIELECTRIC AND SUPERCONDUCTIVE COMPOSITIONS

(75) Inventors: Tsutomu Tatekawa, Otsu (JP); Yuji Kintaka, Omihachiman (JP); Hiroshi Tamura, Otsu (JP); Akio Oota, Toyohashi (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/274,616

(22) Filed: Mar. 23, 1999

(30) Foreign Application Priority Data

Mar. 25, 1990 (JP) ..... 10-098520

(51) Int. Cl.[7] ..... H01P 1/213; H01P 1/20; H01P 7/10; H01B 12/02

(52) U.S. Cl. ..... 505/210; 505/238; 505/239; 505/700; 505/701; 505/866; 333/219; 333/204; 333/134

(58) Field of Search ..... 333/995, 219, 333/204, 134; 505/210, 238, 239, 700, 701, 866

(56) References Cited

U.S. PATENT DOCUMENTS 5,110,790 A * 5/1992 Feenstra et al. ..... 505/701 X
5,750,473 A * 5/1998 Shen ..... 333/995 X
6,067,461 A * 5/2000 Ye et al. ..... 333/995 X

FOREIGN PATENT DOCUMENTS

JP 6053556 * 2/1994 ..... 505/239
WO 97/41616 11/1887
WO 96/42117 12/1996

OTHER PUBLICATIONS

"Low Order Modes of YBCO/STO/YBCO Circular Disk Resonators"; S. Gevorgian, et al.; *IEEE Transactions on Microwave Theory and Techniques*; vol. 44, No. 10; Oct. 1996; pp. 1738–1741.

"Dielectric Properties of $Sr(Mg_{1/3}Nb_{2/3})O_3$–$Ba(Mg_{1/3}Nb_{2/3})O_3$ Solid"; K. Hyun, et al.; *Journal of Materials Science Letters*; 8 (1989) Jul.; No. 7; London, GB; pp. 819–822.

"Low Temperature Properties of Microwave Dielectrics"; H. Tamura, et al.; *Japanese Journal of Applied Physics*; 28 (1999) Suppl., 28–2; pp. 21–23; Tokyo, Japan.

* cited by examiner

*Primary Examiner*—Benny T Lee
(74) *Attorney, Agent, or Firm*—Ostrolenk, Faber, Gerb & Soffen, LLP

(57) ABSTRACT

A compact dielectric resonator of high Qu, in which an electrode formed of an oxide superconducting material is provided on a surface of the dielectric so as to serve as an electrode. A dielectric filter, dielectric duplexer and a communications device, in which the compact resonator is incorporated, are also provided. The dielectric which constitutes the dielectric resonator of the present invention is preferably a $Ba(Mg, Ma)0_3$-based dielectric (wherein Ma is at least one pentavalent elemental metal but cannot be Ta alone), and the oxide superconducting electrode is formed of an oxide superconducting material selected from among a RE—M—Cu—O-based oxide superconducting material (wherein RE is a rare earth element and M is an alkaline earth metal element), a Bi—Sr—Ca—Cu—O-based oxide superconducting material (which encompasses those in which Bi is partially substituted by Pb), and a Tl—Ba—Ca—Cu—O-based oxide superconducting material.

20 Claims, 7 Drawing Sheets

DIELECTRIC RESONATOR, DIELECTRIC FILTER, DIELECTRIC DUPLEXER, AND COMMUNICATIONS DEVICE HAVING SPECIFIC DIELECTRIC AND SUPERCONDUCTIVE COMPOSITIONS

BACKGROUND OF THE INVENTION

1. Field of the Invention

The present invention relates to a compact dielectric resonator of a very high value of Q, to a dielectric filter making use of the resonator, to a dielectric duplexer and to a communications device.

2. Background Art

Recently, dielectric resonators utilizing a dielectric as a material for constructing the resonator have been widely used so as to miniaturize the resonant system of an electric circuit which handles high-frequency waves such as microwaves. Such dielectric resonators utilize the phenomenon that the wavelength of an electromagnetic wave in a dielectric is $1/(\in r)^{1/2}$(wherein $\in r$ represents relative dielectric constant) that measured in free space. Dielectric resonators are used in a variety of resonant modes, including the TE, TM and TEM modes. In order to prevent electromagnetic energy from being scattered and lost, dielectric resonators are usually housed in a metallic casing, or alternatively, metal electrodes are formed on the dielectric surface.

In resonant systems of the above-mentioned types, Qu (i.e., Q under no-load) varies not only depending on Qd (=1/tan δ, Q of the dielectric per se) but also on Qc (i.e., Q attributed to a conductor loss which is caused by the current that flows in the surface of metal). Qu is expressed by the following equation: 1/Qu=(1/Qd)+(1/Qc). Therefore, in order to realize a resonant system of a high Qu, it is essential that a dielectric material of high Qd be used, and in addition, it is essential that electrodes of high Qc—in other words, electrodes of small conductor loss—be used.

Japanese Patent Application Laid-Open (kokai) No. 1-154603 discloses a method for achieving a high Qu (Q under no-load) by forming RE—M—Cu—O-based superconducting electrodes on a dielectric ceramic of any of a variety of types, including $MgTiO_3$—(Ca, Me)$TiO_3$-based dielectric ceramic, Ba(Zr, Zn, Ta)$O_3$-based dielectric ceramic, (Zr, Sn)$TiO_4$ and BaO—PbO—$Nd_2O_3$—$TiO_2$-based dielectric ceramic. Also, Japanese Patent Application Laid-Open (kokai) No. 9-298404 discloses a method which utilizes Ba(Mg, Ta)$O_3$ as a dielectric material.

FIGS. 1 and 2 are graphs showing temperature-dependent characteristics of tan δ(=1/Qd) at 10 GHz for a variety of dielectric materials. As shown in FIGS. 1 and 2, $MgTiO_3$—(Ca, Me)$TiO_3$-based material, Ba(Zr, Zn, Ni, Ta)$O_3$-based material, BaO—PbO—$Nd_2O_3$—$TiO_2$-based material, and Ba(Mg, Ta)$O_3$-based material exhibit disadvantageously poor low-temperature characteristics because in each case, tan δ does not decrease at a constant rate across an entire range of low temperatures.

In a (Zr, Sn)$TiO_4$-based dielectric material, tan δ decreases at a constant rate throughout the low temperature range. However, this material has a disadvantage in that a violent interface reaction occurs between the resultant dielectric and superconducting electrodes. Particularly when a thick film is formed through screen printing, interfacial reaction between a dielectric and oxide superconducting material raises a critical issue; violent interfacial reaction degrades the superconducting material and therefore no superconducting characteristic can be obtained. Therefore, in order to pursue practical use of various products derived from superconducting materials, there exists a strong need for a new substrate material that does not cause interfacial reaction. MgO is a candidate dielectric material that does not cause interfacial reaction between the dielectric and oxide superconducting material, and thus is suitable for use with high-frequency waves. However, MgO has an $\in r$ (relative dielectric constant) of 9–10, which is low as compared to that of the above-mentioned dielectric ($\in r$=20–30), making MgO disadvantageous in terms of miniaturizing the resonant system.

SUMMARY OF THE INVENTION

Accordingly, a primary object of the present invention is to provide a compact dielectric resonator of high Qu, in which an electrode formed of oxide superconducting material is provided on a surface of the dielectric.

Another object of the present invention is to provide a dielectric filter making use of such a compact resonator.

A further object of the present invention is to provide a dielectric duplexer making use of the compact resonator.

A still further object of the present invention is to provide a communications device making use of the compact resonator.

In a first aspect of the present invention, there is provided a dielectric resonator comprising a dielectric and an oxide superconducting electrode provided on a surface of the dielectric, wherein the dielectric is a Ba(Mg, Ma)$O_3$-based dielectric (wherein Ma is at least one pentavalent elemental metal but cannot be Ta alone), and the oxide superconducting electrode is formed of an oxide superconducting material selected from among a RE—M—Cu—O-based oxide superconducting material (wherein RE is a rare earth element and M is an alkaline earth metal element), a Bi—Sr—Ca—Cu—O-based oxide superconducting material (which encompasses those in which Bi is partially substituted by Pb), and a Tl—Ba—Ca—Cu—O-based oxide superconducting material.

Preferably, Ma is at least one element selected from among Ta, Sb and Nb (except the case where Ta is used alone).

In a second aspect of the present invention, there is provided a dielectric resonator comprising a dielectric and an oxide superconducting electrode provided on a surface of the dielectric, wherein the dielectric is a Ba(Mb, Mg, Ta)$O_3$-based dielectric (wherein Mb is a tetravalent or pentavalent elemental metal), and the oxide superconducting electrode is formed of an oxide superconducting material selected from among a RE—M—Cu—O-based oxide superconducting material (wherein RE is a rare earth element and M is an alkaline earth metal element), a Bi—Sr—Ca—Cu—O-based oxide superconducting material (which encompasses those in which Bi is partially substituted by Pb), and a Tl—Ba—Ca—Cu—O-based oxide superconducting material.

Preferably, Mb is at least one element selected from among Sn, Zr, Sb and Nb.

Preferably, the Ba(Mb, Mg, Ta)$O_3$-based dielectric is a Ba(Sn, Mg, Ta)$O_3$-based dielectric. Preferably, the composition of the Ba (Sn, Mg, Ta)$O_3$-based dielectric is $Ba(Sn_x, Mg_y, Ta_z)O_{7/2-x/2-3y/2}$ (wherein x+y+z=1, $0.04 \leqq x \leqq 0.26$, $0.23 \leqq y \leqq 0.31$, and $0.51 \leqq z \leqq 0.65$).

In a dielectric resonator according to the second aspect of the present invention, the Ba(Mb, Mg, Ta)$O_3$-based dielectric may be a Ba(Mg, Sb, Ta)$O_3$-based dielectric. In this case, the composition of the Ba(Mg, Sb, Ta)$O_3$-based dielectric is $Ba_xMg_y(Sb_v, Ta_{l-v})_zO_w$ (wherein x+y+z=1, w is an arbitrary number, x, y, and z fall within the tetrahedron defined by connecting points A, B, C, and D shown in Table 1, and $0.00 \leqq v \leqq 0.300$).

TABLE 1

| | x | y | z |
|---|---|---|---|
| A | 0.495 | 0.175 | 0.330 |
| B | 0.495 | 0.170 | 0.335 |
| C | 0.490 | 0.170 | 0.340 |
| D | 0.490 | 0.180 | 0.330 |

In the first and second aspects of the present invention, the RE—M—Cu—O-based oxide superconducting material may be $YBa_2Cu_3O_{7-x}$, the Bi—Sr—Ca—Cu—O-based oxide superconducting material may be $(Bi,Pb)_2Sr_2Ca_2CU_3O_x$ or $Bi_2$, $Sr_2CaCu_2O_x$, and the Tl—Ba—Ca—Cu—O-based oxide superconducting material may be $Tl_2Ba_2Ca_2Cu_3O_x$.

In a third aspect of the present invention, there is provided a dielectric filter comprising a dielectric resonator according to any of the above aspects of the present invention, and an external connecting means.

In a fourth aspect of the present invention, there is provided a dielectric duplexer comprising at least two dielectric filters, input-output connection means for each of the dielectric filters, and antenna connecting means which is connected to the dielectric filter, wherein at least one of the dielectric filters is a dielectric filter of the present invention.

In a fifth aspect of the present invention, there is provided a communications device comprising a dielectric duplexer as described above, a transmitting circuit which is connected to at least one input-output connection means of the dielectric duplexer, a receiving circuit which is connected to at least one input-output connection means other than that to be connected to the transmitting circuit, and an antenna which is connected to the antenna connecting means of the dielectric duplexer.

Examples of the RE element that serves as a constituent of the RE—M—Cu—O-based oxide superconducting material include Y, La, Ce, Pr, Nd, Pm, Sm, Eu, Gd, Tb, Dy, Ho, Er, Tm, Yb and Lu. M (i.e., an alkaline earth metal element) is preferably Ba or Sr among others.

Since the surface resistance (Rs) of an oxide superconducting material is lower than that of metal at a temperature lower than a critical temperature (Tc), smaller conductor loss occurs in electrodes, to thereby greatly improve Qc. Also, the dielectric used in the present invention exhibits an excellent tan δ characteristic at a low temperature, and does not cause interfacial reaction with an oxide superconducting material. Therefore, the dielectric of the present invention is suitable for forming an oxide superconducting electrode on the surface thereof.

BRIEF DESCRIPTION OF THE DRAWINGS

The above and other objects, features, and advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

Figure 1:
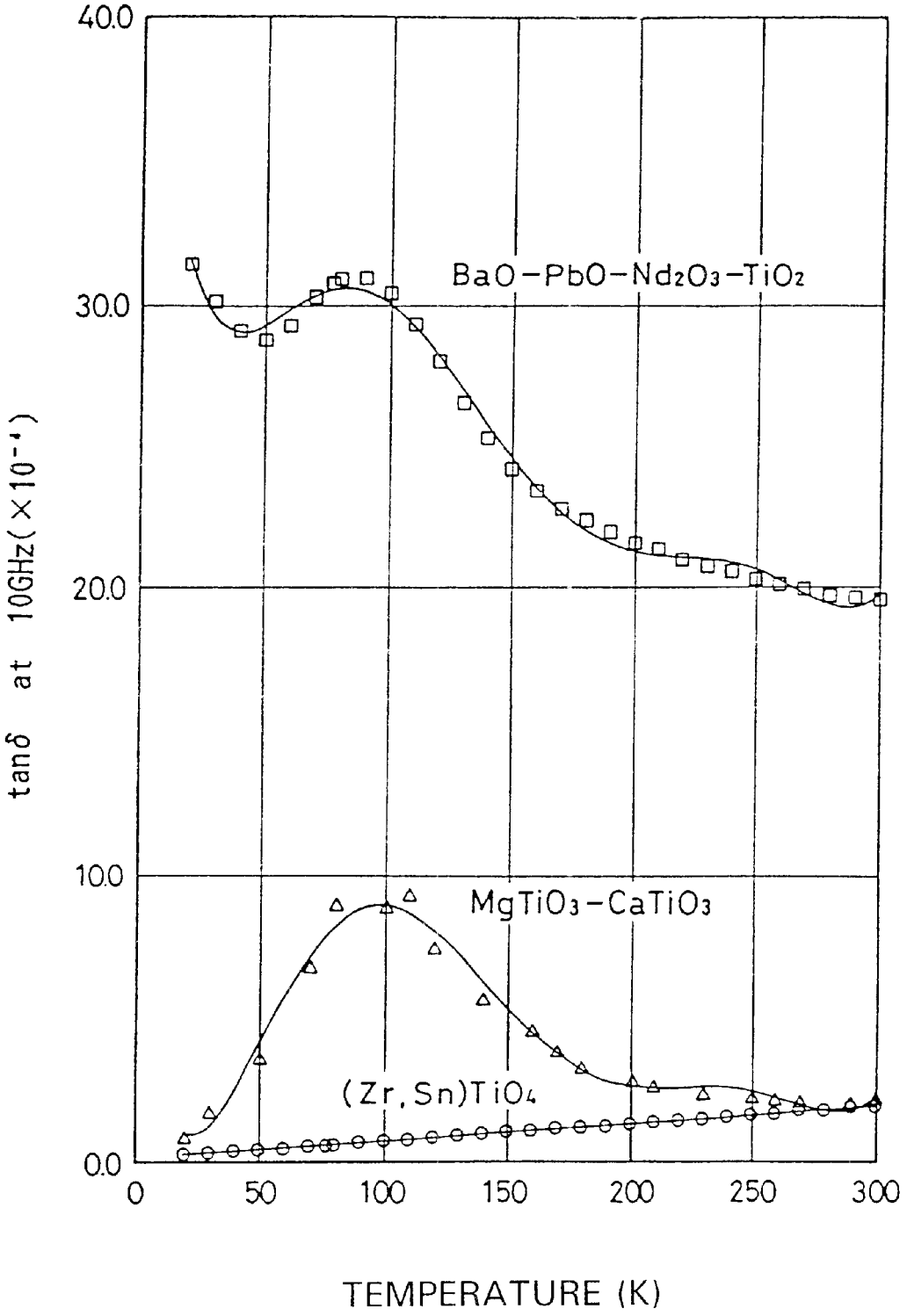
FIGURE 1 PRIOR ART
FIG. 1 is a graph showing the temperature versus tan δ(at 10 GHz) curves of different dielectrics.
Figure 2:
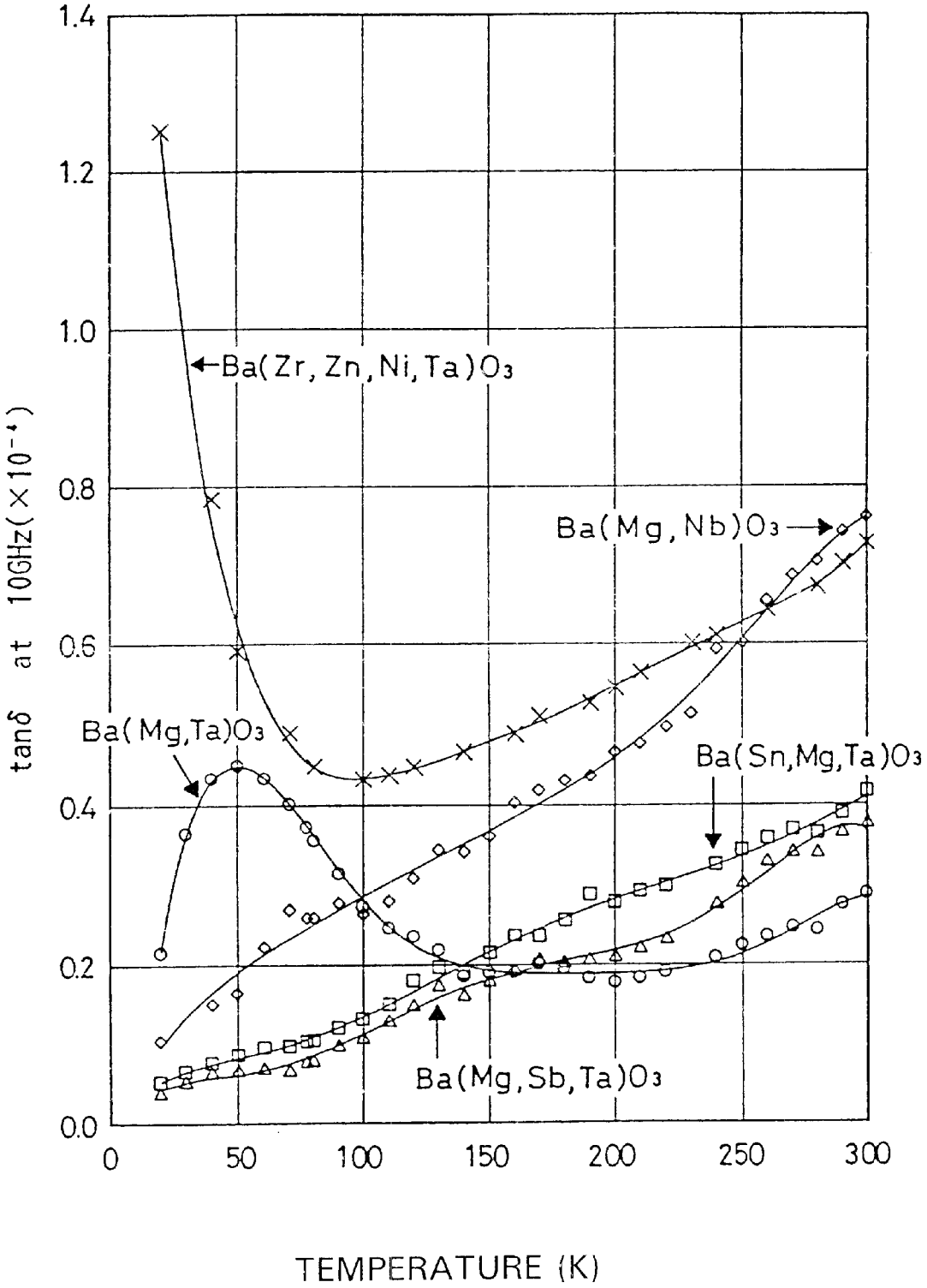
FIGURE 2 PRIOR ART
FIG. 2 is another graph showing the temperature versus tan δ(at 10 GHz) curves of a variety of dielectrics.
Figure 3:
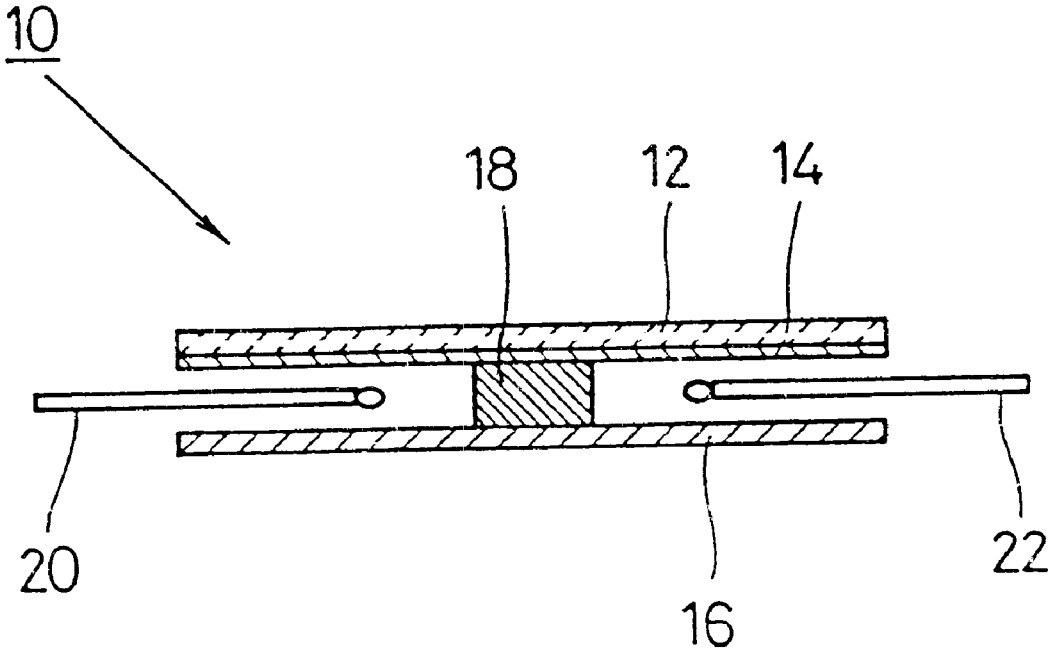
FIG. 3 is an explanatory sketch showing an example dielectric resonator according to the present invention.

FIG. 3 is an explanatory sketch of an example $TE_{011}$-mode dielectric resonator of the present invention.

The resonant system of the dielectric resonator 10 uses a both-terminal-short-circuit-type dielectric resonator method (Hakki & Colemann method), which is a method generally employed for evaluation of microwave-band dielectric characteristics of a dielectric material and for measuring surface resistance of a superconductor. The Hakki & Colemann method generally employs a structure in which a dielectric is sandwiched between two metal plates; however, the dielectric resonator 10 shown in FIG. 3 has a structure in which one of the metal plates is substituted by a superconducting electrode formed on the surface of the dielectric. That is, the dielectric resonator 10 shown in FIG. 3 includes a dielectric substrate 12, and a film-shaped superconducting electrode 14 is formed on the surface of the dielectric substrate 12. A copper plate 16 is disposed to face the superconducting electrode 14. A dielectric 18 is sandwiched between the superconducting electrode 14 and the copper plate 16. Further, two excitation cables 20 and 22 are disposed on opposite sides of the dielectric 18 and between the superconducting electrode 14 and the copper plate 16, such that the cables 20 and 22 face each other.

In the dielectric resonator of FIG. 3, a Ba(Sn, Mg, Ta)$O_3$-based dielectric (size: ϕ8.5 mm×t3.8 mm) is used as a dielectric 18. The composition is Ba $(Sn_xMg_yTa_z)O_{7/2-x/2-3y/2}$ (in which x+y+z=1, $0.04 \leqq x \leqq 0.26$, $0.23 \leqq y \leqq 0.31$, $0.51 \leqq z \leqq 0.65$). The dielectric substrate 12 on which the superconducting electrode 14 is formed was also fabricated from Ba(Sn, Mg, Ta)$O_3$.

In this dielectric resonator, Bi—Pb—Sr—Ca—Cu—O film or Y—Ba—Cu—O film is used as the superconducting electrode 14. More specifically, for example, $(Bi, Pb)_2Sr_2Ca_2Cu_3O_x$ or $YBa_2Cu_3O_{7-x}$ is used. The superconducting electrode 14 using one of these materials can be formed, for example, in the following manner.

A Bi—Pb—Sr—Ca—Cu—O film can be formed by use of the following method. A powder of the composition Bi—Pb—Sr—Ca—Cu—O (2223 phase) and an organic vehicle are mixed, subjected to adjustment of the viscosity thereof, and screen-printed on the dielectric substrate 12. The resultant film is dried at 100° C. to 150° C., and the dried film is fired at 840° C. to 860° C. for 100 to 200 hours in air.

A Y—Ba—Cu—O film can be formed by use of the following method. A powder of the composition. Y—Ba—Cu—O and an organic vehicle are mixed, subjected to adjustment of the viscosity thereof, and screen-printed on the dielectric ceramic. The resultant film is fired at 860° C. to 880° C. for 5 to 10 hours in an oxygen atmosphere.

A dielectric resonator 10 having the Bi—Pb—Sr—Ca—Cu—O film serving as the superconducting electrode 14 and a dielectric resonator 10 having the Y—Ba—Cu—O film were formed, and low-temperature Qu was measured. The results are plotted by use of open circles and open triangles in FIG. 4. BPSCCO appearing in FIG. 4 represents Bi—Pb—Sr—Ca—Cu—O, and YBCO therein represents Y—Ba—Cu—O.

Further, as a first comparative example, there was fabricated a dielectric resonator having the same structure as the dielectric resonator 10 shown in FIG. 3 except that a copper plate was provided in place of the superconducting electrode 14. In other words, the dielectric resonator of the first comparative example has the same structure as the dielectric resonator 10 shown in FIG. 3 except that the dielectric 18 is sandwiched between two copper plates. Low-temperature Qu of the dielectric resonator of the first comparative example was measured, and the results are plotted by use of filled rhombuses in FIG. 4.

Figure 4:
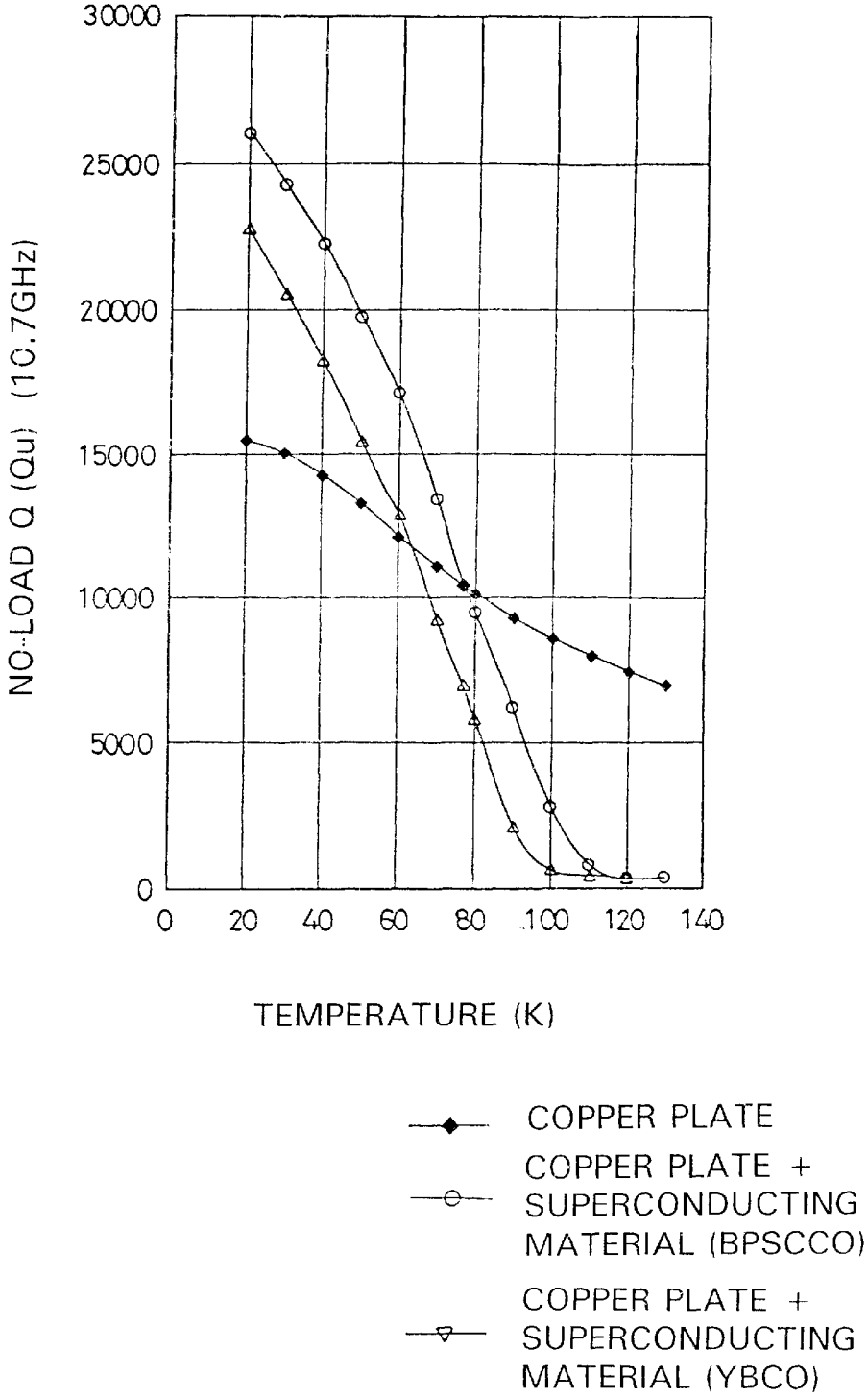
FIG. 4 is a graph showing the low-temperature Qu (Q under no load) characteristics of $TE_{011}$-mode dielectric resonators.

As is apparent from FIG. 4, the dielectric resonators 10 can achieve Qu higher than that of the dielectric resonator in the first comparative example in which the dielectric is sandwiched between two copper plates. Namely, the superconducting electrode 14 formed on the dielectric substrate 12 does not undergo interfacial reaction with the dielectric but exhibits superconducting characteristics.

Figure 5:
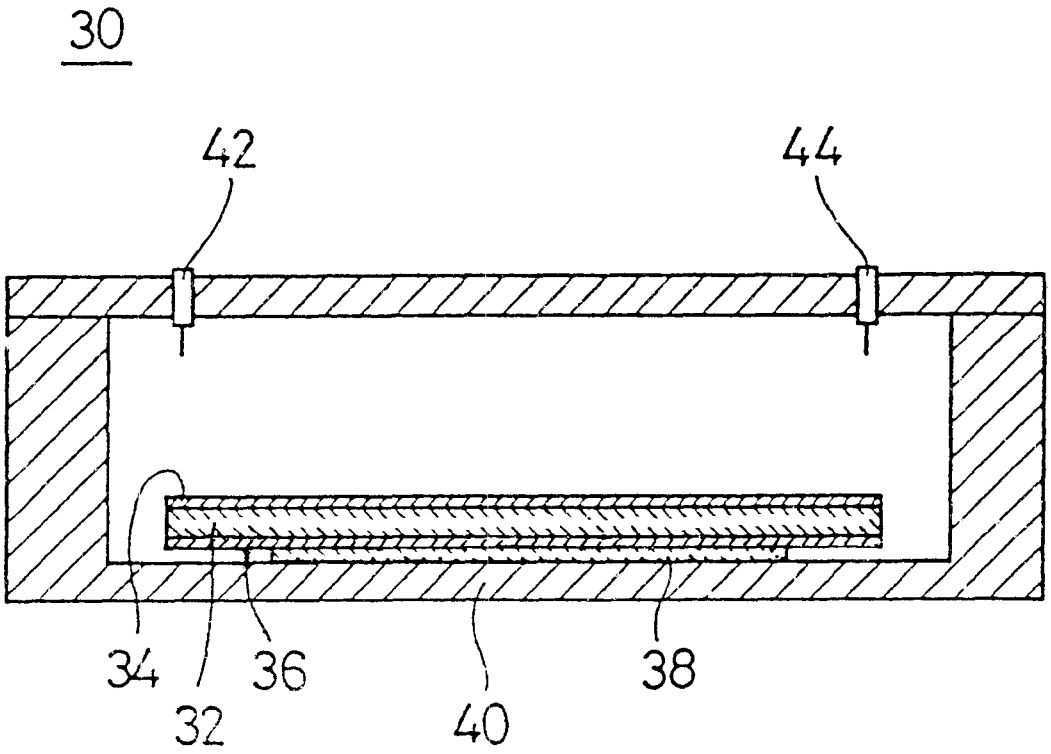
FIG. 5 is an explanatory sketch showing another example dielectric resonator according to the present invention.

FIG. 5 is an explanatory sketch of an example $TM_{010}$-mode dielectric resonator of the present invention. The dielectric resonator 30 shown in FIG. 5 includes a dielectric substrate 32. Film-shaped superconducting electrodes 34 and 36 are formed on the top and bottom surfaces of the dielectric substrate 32, respectively. The dielectric substrate 32 is fixed within a metal casing 40 through the mediation of a Teflon sheet 38. An excitation cable 42 is disposed at one end of the metal casing 40, and an excitation cable 44 is disposed at the other end.

The dielectric substrate 32 of this resonator 30 was also fabricated from Ba(Sn, Mg, Ta)$O_3$-based dielectric as in the dielectric resonator 10. The superconducting electrodes 34 and 36 were fabricated from Bi—Pb—Sr—Ca—Cu—O film by use of the above-mentioned method. Low-temperature Qu was measured, and the results are plotted by use of open circles in FIG. 6. BPSCCO appearing in FIG. 6 represents Bi—Pb—Sr—Ca—Cu—O.

Further, as a second comparative example there was fabricated a dielectric resonator having the same structure as the dielectric resonator 30 shown in FIG. 5, except that a copper thin film was formed on the dielectric substrate 32 instead of the superconducting electrodes 34 and 36. In other words, the dielectric resonator of the second comparative example has the same structure as the dielectric resonator 30 shown in FIG. 5 except that the dielectric 32 is sandwiched between two copper thin films. The low-temperature Qu of the dielectric resonator of the second comparative example was measured, and the results are plotted by use of black rhombuses in FIG. 6.

Figure 6:
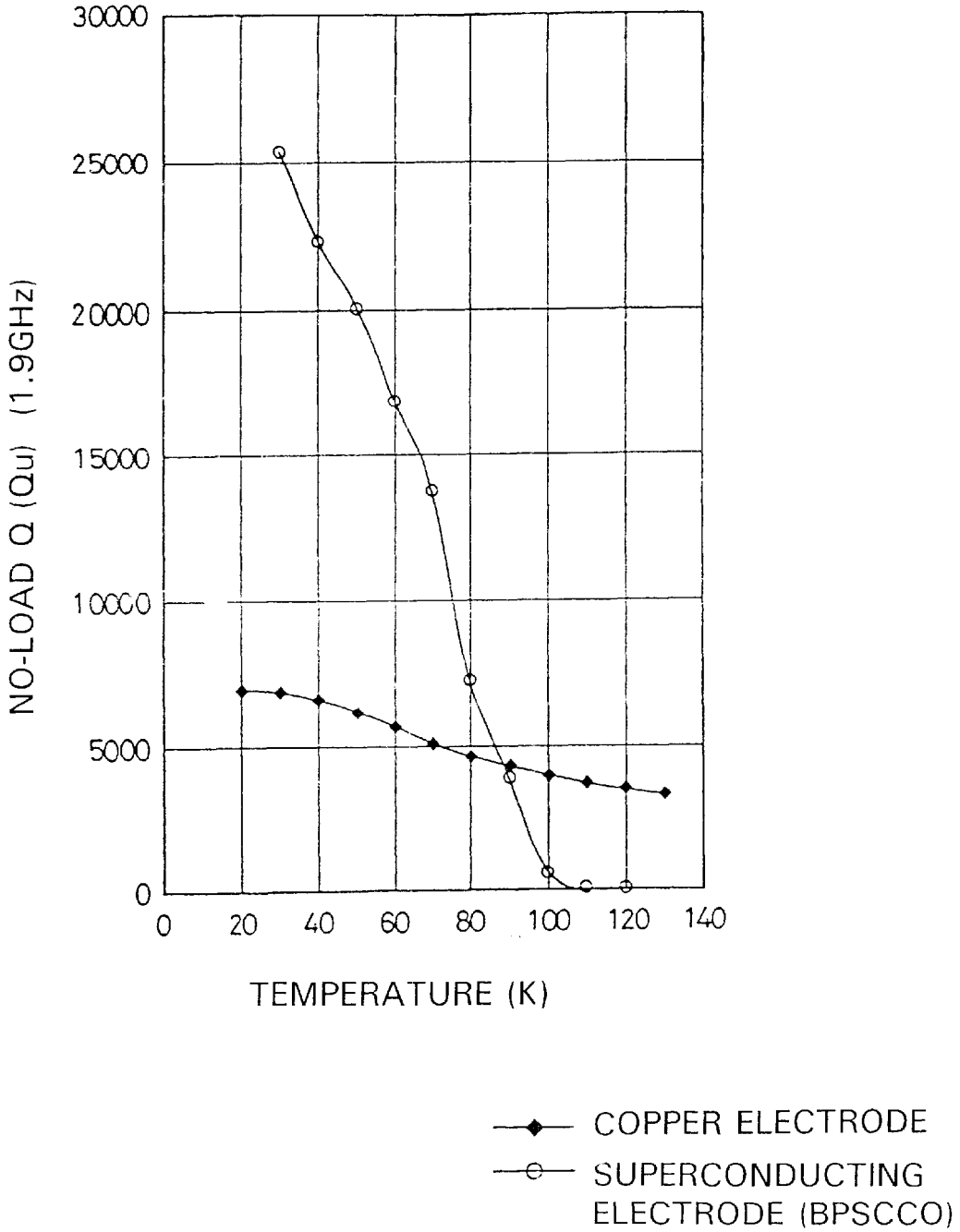
FIG. 6 is a graph showing the low-temperature Qu (Q under no load) characteristics of $TE_{010}$-mode dielectric resonators.

As is apparent from FIG. 6, the dielectric resonators 30 can achieve a Qu higher than that of the dielectric resonator of the second comparative example. Namely, the superconducting electrodes 34 and 36 formed on the top and bottom surfaces of the dielectric substrate 32 do not undergo an interfacial reaction with the dielectric but exhibit superconducting characteristics.

The case in which Ba(Sn, Mg, Ta)$O_3$-based dielectric was used as a dielectric has been described with reference to embodiment examples and the related data shown in FIGS. 3 through 6; however, when other dielectrics described hereinabove are used, the same effect can be produced. Further, the oxide superconducting material is not limited only to the materials used in the embodiments as described with reference to FIGS. 3 and 5; when other oxide superconducting materials hereinabove are used, the same effect can be produced.

A $TE_{011}$-mode dielectric resonator and a $TE_{010}$-mode dielectric resonator have been described with reference to FIGS. 3 through 6; however, the present invention is not limited to only these types of resonators. The invention can be also applied to other types of dielectric resonators, for example, other TE-mode, TM-mode, TEM-mode dielectric resonators or resonators in which strip lines are fabricated on the dielectric substrate thereof.

Figure 7:
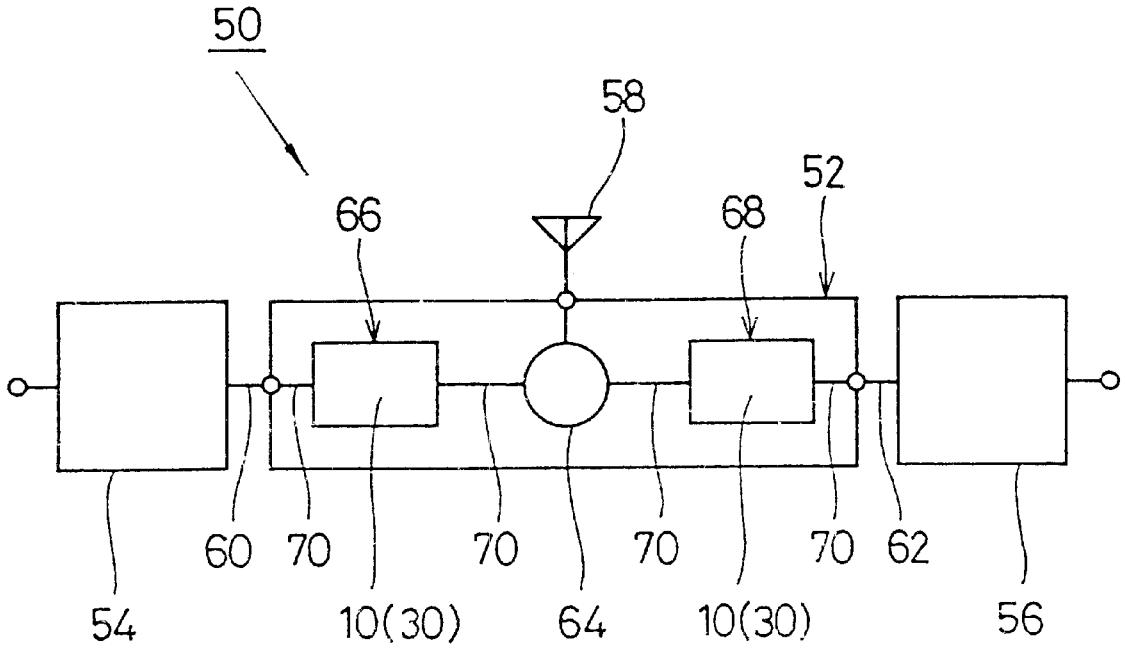
FIG. 7 is a block diagram showing an example communications device according to the present invention.

FIG. 7 is a block diagram of an example communications device using the dielectric resonator of the present invention. The communications device 50 includes a dielectric duplexer 52, a transmitting circuit 54, a receiving circuit 56, and an antenna 58. The transmitting circuit 54 is connected to an input means 60 of the dielectric duplexer 52, and the receiving circuit 56 is connected to an output means 62 of the dielectric duplexer 52. The antenna 58 is connected to an antenna connecting means 64 of the dielectric duplexer 52. The dielectric duplexer 52 includes two dielectric filters 66 and 68. The dielectric filters 66 and 68 each include the dielectric resonator of the present invention and external connecting means connected to the resonator. In this example communications device, the filters are formed by connecting external connecting means 70 to the excitation cables of the dielectric resonators 10 (30); one dielectric filter 66 is connected between the input means 60 and the antenna connecting means 64, and the other dielectric filter 68 is connected between the antenna connecting means 64. and the output means 62.

As described above, in the dielectric resonator according to the present invention, no interfacial reaction occurs between the dielectric and the superconducting material to thereby provide an excellent superconducting characteristic, achieving a higher Qu than the case in which metal electrodes are used. Therefore, when such a dielectric resonator of the present invention is incorporated into a dielectric filter, dielectric duplexer or a communications device, excellent working characteristics can be obtained.

What is claimed is:

1. A dielectric resonator comprising a dielectric and an oxide superconducting thick film electrode on a surface of the dielectric, wherein the dielectric is a Ba(Mg, Ma)$O_3$ dielectric in which Ma is at least one pentavalent metal or the combination of Ta and a tetravalent metal but does not represent Ta alone, and the oxide superconducting electrode is an oxide superconducting material selected from the group consisting of a RE—M—Cu—O oxide superconducting material in which RE is a rare earth element and M is an alkaline earth metal element, an A—Sr—Ca—Cu—O oxide superconducting material in which A is Bi or the combination of Bi and Pb, and a Tl—Ba—Ca—Cu—O oxide superconducting material.

2. A dielectric resonator according to claim 1, wherein the dielectric is a Ba(Mg, Ma)$O_3$ dielectric in which Ma is said at least one pentavalent metal.

3. A dielectric resonator according to claim 2, wherein said pentavalent metal Ma is at least one metal selected from among Ta, Sb and Nb, but does not represent Ta alone.

4. A dielectric resonator according to claim 2, wherein said oxide superconducting material is selected from the group consisting of $YBa_2CU_3O_{7-x}$, $(Bi,Pb)_2Sr_2Ca_2Cu_3O_x$, $Bi_2,Sr_2CaCu_2O_x$ and $Tl_2Ba_2Ca_2Cu_3O_x$.

5. A dielectric resonator according to claim 1, wherein Ma is a combination of Ta and Mb and said dielectric is of the formula $Ba(Mb, Mg, Ta)O_3$ in which Mb represents the tetravalent metal.

6. A dielectric resonator according to claim 5, wherein said tetravalent metal Mb is at least one element selected from the group consisting of Sn, Zr, Sb and Nb.

7. A dielectric resonator according to claim 6, wherein said $Ba(Mb, Mg, Ta)O_3$ dielectric is a $Ba(Sn, Mg, Ta)O_3$ dielectric.

8. A dielectric resonator according to claim 7, wherein said $Ba(Sn, Mg, Ta)O_3$ dielectric is represented by $Ba(Sn_x, Mg_y, Ta_z)O_{7/2-x/2-3y/2}$, wherein $x+y+z=1$, $0.04 \leqq x \leqq 0.26$, $0.23 \leqq y \leqq 0.31$, and $0.51 \leqq z \leqq 0.65$.

9. A dielectric resonator according to claim 6, wherein said $Ba(Mb, Mg, Ta)O_3$ dielectric is a $Ba(Mg, Sb, Ta)O_3$ dielectric.

10. A dielectric resonator according to claim 9, wherein said $Ba(Mg, Sb, Ta)O_3$ dielectric has a composition represented by $Ba_xMg_y(Sb_v, Ta_{l-v})_zO_w$ wherein $x+y+z=1$, w is an arbitrary number, and x, y, and z fall within the tetrahedron defined by connecting points A, B, C, and D:

| | x | y | z |
|---|---|---|---|
| A | 0.495 | 0.175 | 0.330 |
| B | 0.495 | 0.170 | 0.335 |
| C | 0.490 | 0.170 | 0.340 |
| D | 0.490 | 0.180 | 0.330 |

and $0.001 \leqq v \leqq 0.300$.

11. A dielectric resonator according to claim 5, wherein said oxide superconducting material is selected from the group consisting of $YBa_2Cu_3O_{7-x}$, $(Bi, Pb)_2Sr_2Ca_2Cu_3O_x$, $Bi_2$, $Sr_2CaCu_2O_x$ and $Tl_2Ba_2Ca_2CU_3O_x$.

12. A dielectric filter comprising a dielectric resonator including a dielectric and an oxide superconducting thick film electrode on a surface of the dielectric, wherein the dielectric is a $Ba(Mg, Ma)O_3$ dielectric in which Ma is at least one pentavalent metal or the combination of Ta and a tetravalent metal but does not represent Ta alone, and the oxide superconducting electrode is an oxide superconducting material selected from the group consisting of a RE—M—Cu—O oxide superconducting material in which RE is a rare earth element and M is an alkaline earth metal element, an A—Sr—Ca—Cu—O oxide superconducting material in which A is Bi or the combination of Bi and Pb, and a Tl—Ba—Ca—Cu—O oxide superconducting material;

in combination with a connector terminal.

13. A dielectric duplexer comprising at least two dielectric filters, respective input-output connector terminals for the dielectric filters, and further comprising an antenna connector terminal in communication with both of the dielectric filters, wherein at least one of the dielectric filters is a dielectric filter of claim 12 and the respective connector terminal of said at least one dielectric filter serves as the corresponding input-output connector terminal thereof.

14. A communications device comprising a dielectric duplexer of claim 13, a transmitting circuit connected to one of the input-output connector terminals of the dielectric duplexer, a receiving circuit which is connected to another one of the input-output connector terminals other than that to be connected to the transmitting circuit, and an antenna connected to the antenna connector terminal of the dielectric duplexer.

15. A dielectric filter comprising a dielectric resonator including a dielectric and an oxide superconducting thick film electrode on a surface of the dielectric, wherein the dielectric is a $Ba(Mg, Ma)O_3$ dielectric in which Ma is at least one pentavalent metal; and the oxide superconducting electrode is an oxide superconducting material selected from the group consisting of a RE—M—Cu—O oxide superconducting material in which RE is a rare earth element and M is an alkaline earth metal element, an A—Sr—Ca—Cu—O oxide superconducting material in which A is Bi or the combination of Bi and Pb, and a Tl—Ba—Ca—Cu—O oxide superconducting material;

in combination with a connector terminal.

16. A dielectric duplexer comprising at least two dielectric filters, respective input-output connector terminals for the dielectric filters, and further comprising an antenna connector terminal in communication with both of the dielectric filters, wherein at least one of the dielectric filters is a dielectric filter of claim 15 and the respective connector terminal of said at least one dielectric filter serves as the corresponding input-output connector terminal thereof.

17. A communications device comprising a dielectric duplexer of claim 16, a transmitting circuit connected to one of the input-output connector terminals of the dielectric duplexer, a receiving circuit which is connected to another one of the input-output connector terminals other than that to be connected to the transmitting circuit, and an antenna connected to the antenna connector terminal of the dielectric duplexer.

18. A dielectric filter comprising a dielectric resonator including a dielectric and an oxide superconducting thick film electrode on a surface of the dielectric, wherein the dielectric is a $Ba(Mb, Mg, Ta)O_3$ dielectric in which Mb represents a tetravalent metal; and the oxide superconducting electrode is an oxide superconducting material selected from the group consisting of a RE—M—Cu—O oxide superconducting material in which RE is a rare earth element and M is an alkaline earth metal element, an A—Sr—Ca—Cu—O oxide superconducting material in which A is Bi or the combination of Bi and Pb, and a Tl—Ba—Ca—Cu—O oxide superconducting material;

in combination with a connector terminal.

19. A dielectric duplexer comprising at least two dielectric filters, respective input-output connector terminals for the dielectric filters, and further comprising an antenna connector terminal in communication with both of the dielectric filters, wherein at least one of the dielectric filters is a dielectric filter of claim 18 and the respective, connector terminal of said at least one dielectric filter serves as the corresponding input-output connector terminal thereof.

20. A communications device comprising a dielectric duplexer of claim 19, a transmitting circuit connected to one of the input-output connector terminals of the dielectric duplexer, a receiving circuit which is connected to another one of the input-output connector terminals other than that to be connected to the transmitting circuit, and an antenna connected to the antenna connector terminal of the dielectric duplexer.

* * * * *